US007163034B2

(12) United States Patent
Franks

(10) Patent No.: US 7,163,034 B2
(45) Date of Patent: Jan. 16, 2007

(54) FLUID TRANSFER SYSTEM

(76) Inventor: Normal Alton Franks, 17060 S. Shore La., Eden Prairie, MN (US) 55346

( * ) Notice: Subject to any disclaimer, the term of this patent is extended or adjusted under 35 U.S.C. 154(b) by 162 days.

(21) Appl. No.: 10/968,396

(22) Filed: Oct. 19, 2004

(65) Prior Publication Data

US 2006/0081304 A1 Apr. 20, 2006

(51) Int. Cl.
*B65B 1/08* (2006.01)

(52) U.S. Cl. ..... 141/67; 141/98; 141/384; 141/386; 222/383.2; 418/265

(58) Field of Classification Search ..... 141/2, 141/7, 18, 21, 27, 65, 67, 98, 363–366, 383–386, 141/392; 222/482, 529, 530, 608, 383.2; 418/265, 266
See application file for complete search history.

(56) References Cited

U.S. PATENT DOCUMENTS 1,711,134 A * 4/1929 Brand ..... 222/331
1,942,367 A * 1/1934 Valentine ..... 222/379
5,494,191 A * 2/1996 Benson ..... 222/23
5,667,113 A * 9/1997 Clarke et al. ..... 222/608

* cited by examiner

*Primary Examiner*—Timothy L. Maust
(74) *Attorney, Agent, or Firm*—Nikolai & Mersereau, P.A.; Thomas J. Nikolai

(57) ABSTRACT

A portable fluid transfer apparatus for handling volatile fuels or other chemicals comprises a jug-like container of a convenient volume having a removable cap that can be screwed or clamped onto the neck of the jug and mounted atop the cap is a manually operable rotary vane pump having a first inlet/outlet port disposed within the container when the cap is in place and a second inlet/outlet port external of the jug or container. An elongated, suction/discharge hose having a tether for anchoring the end of the hose in place is affixed to the second inlet/outlet. Manual actuation of the vane pump is then used to transfer a liquid from or into the portable container.

11 Claims, 2 Drawing Sheets

FLUID TRANSFER SYSTEM

BACKGROUND OF THE INVENTION

I. Field of the Invention

This invention relates generally to fluid transfer apparatus, and more particularly to a portable container for a liquid having a built-in, manual pump for transferring a liquid into or from the portable container.

II. Discussion of the Prior Art

There are many instances where a liquid must be dispensed from a first container to a second container rapidly and without any spillage. For example, in fueling an internal combustion engine, gasoline or diesel fuel must be carried in a portable container to the location of the engine fuel tank and the fuel poured from the transporting container into the fuel tank without spillage. This task becomes difficult where the entrance opening to the engine's fuel tank is relatively small in size or is at an angle to the horizontal or a difficult to reach location. In an attempt to address the small size issue, the prior art solution has generally been to utilize a funnel, but this solution has its drawbacks. Specifically, the rate at which the fuel can be poured from an auxiliary gas can into the engine's tank is limited by the build-up of a back pressure as the fuel displaces air in the engine's fuel tank. Air can only escape back up through the opening in the funnel which not only produces harmful fumes, but also possible splattering of the fuel being poured.

With volatile fuels, such as gasoline, a potential exists for explosion or fire if static electric charge is able to build up on one or the other of the container transporting the fuel and the tank into which the fuel is to be deposited. If the charge is sufficiently high, a spark can result that can ignite fumes resulting as the fuel is being poured into the engine's tank.

In agricultural applications, a farmer may have to deal with liquid fertilizers and herbicides, transferring the chemical from a container transported to the field and into the tank of an agricultural sprayer. Here again, as in the case of handling engine fuels, it is important that spillage be minimized or eliminated. Plumbers and building maintenance workers often face a need to pump liquids from toilets, plugged sinks into a container for later disposal.

It is accordingly a principal object of the present invention to provide a safe, convenient and expeditious way of transferring a liquid from a first container into a second container that avoids the possibility of spillage and which minimizes fume escape and the possibility of fuel ignition due to static electricity discharges.

SUMMARY OF THE INVENTION

The instant invention comprises a fluid transfer apparatus that includes a jug-like container having a neck sealable by a cap member and a carrying handle. Affixed to the cap member is a rotary vane pump that has a first inlet/outlet port extending through the cap to an interior of the jug and a second inlet/outlet port exterior of the jug. A suction/discharge hose has a first end thereof connected to the second inlet/outlet port of the pump and a second end adapted for placement in a container for a liquid. A tether has one end thereof slidable along an exterior of the suction/discharge hose and a clamp member affixed to another end of the tether whereby the second end of the suction/discharge hose can be prevented from falling out of the container into or from which the liquid in the jug is to be transferred. Rotation of the vane pump in a first direction is effective to draw the liquid in the jug through the first inlet/outlet port and out the second inlet/outlet port and through the suction/discharge hose into the container or tank to be filled. By rotating the vane pump in the opposite direction, a liquid may be drawn from a supply container through the suction/discharge hose and the second inlet/outlet port and into the jug, via the first inlet/outlet port. The tether also serves to maintain the suction/discharge hose in the container to be filled or emptied at the same electrical potential such that static discharges are eliminated.

DESCRIPTION OF THE DRAWINGS

The foregoing features, objects and advantages of the invention will become apparent to those skilled in the art from the following detailed description of a preferred embodiment, especially when considered in conjunction of the accompanying drawings in which.

DESCRIPTION OF THE PREFERRED EMBODIMENT

Figure 1:
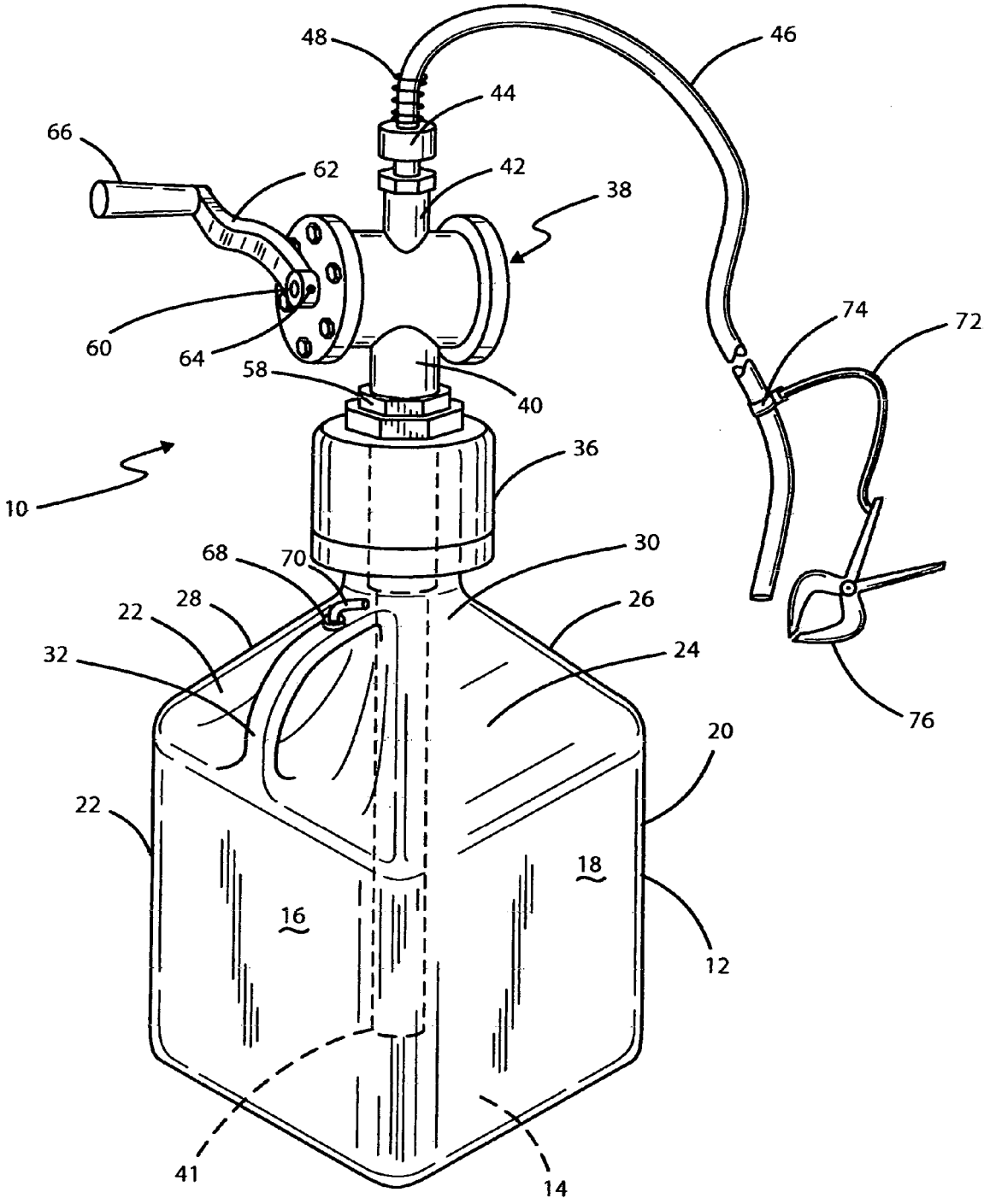
FIG. 1 is a perspective view of the preferred embodiment of a fluid transfer apparatus constructed in accordance with the present invention.

Referring to FIG. 1, there is illustrated by means of a perspective view a preferred embodiment of the fluid transfer apparatus of the present invention. It is indicated generally by numeral 10 and is seen to comprise a container 12, preferably formed from a suitable plastic, such as polyethylene, in a roto-molding operation so as to have a wall thickness of about $1/16^{th}$ inch and a length, width and depth dimension giving the container a capacity of approximately five U.S. gallons. It is to be understood that these dimensions are exemplary and should not be considered as limiting of the invention. An adult can readily carry the container filled with five gallons of most liquids. The container has a bottom 14 and four mutually perpendicular side walls 16, 18, 20 and 22 rising upwardly from the bottom 14 for a predetermined distance then sloping upwardly and inwardly as at 22, 24, 26 and 28 to form a neck or spout 30. Formed integrally with the container or jug 12 is a carrying handle 32 by which a person may conveniently lift and carry the apparatus 10. While a jug of rectangular cross-section is depicted in the drawings, the jug may just as well be round.

Figure 2:
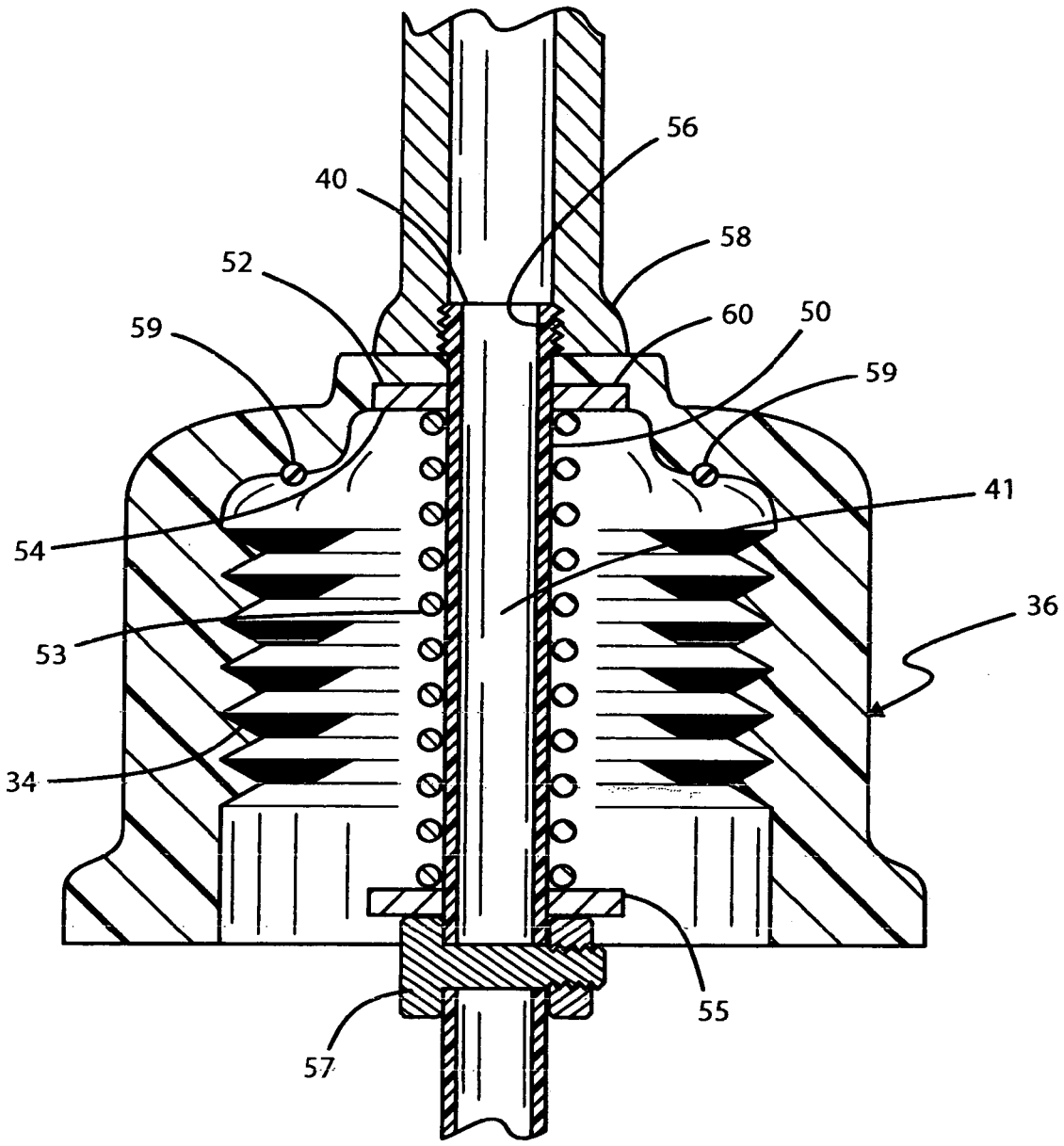
FIG. 2 is a sectional view taken through a cap that is adapted to be removably secured to the spout of the jug shown in FIG. 1.

The neck 30 of the jug 12 has external threads formed thereon for mating with internal threads as at 34 (FIG. 2) of a cap 36. Rotatably mounted atop the cap 36 is a rotary vane pump, indicated generally by numeral 38. The rotary vane pump is a commercially available item and it has a first inlet/outlet port 40 in which a flexible or rigid pipe or tube 41 is connected by screw threads. Pipe or tube 41 penetrates through a bore 50 formed in the top of the cap 36. The flexible or rigid pipe 41 is long enough to reach the bottom 24 of the jug 12. The pump has a second inlet/outlet port 42 to which is attached a hose adapter 44 for connecting a suction/discharge tube 46 thereto. A strain relief spring 48 surrounds the tube 46 to inhibit any tendency for kinking when tension forces are applied to the hose 46.

Referring again to FIG. 2, the manner in which the rotary vane pump 38 is joined to the cap 36 will be described. The cap may be molded from the same material as is used in fabricating the container or jug 12 and the bore 50 is drilled (or otherwise formed during molding) that penetrates through the top of the cap. A counterbore 52 is formed inwardly of the inner top surface of the cap 36 for receiving a toroidal retainer or washer 54 therein. The washer 54 surrounds the tube 41 and is held in place in the counterbore 52 by a flat ground compression coil spring 53 that is held in place by the combination of a further washer 55 and a bolt 57 that extends diametrically through the pipe 41. The bolt 57 serves to prevent the washer 55 from sliding down the pipe 41.

The pipe 41 has external threads 56 proximate its upper end allowing it to be screwed into the flange 58 comprising a part of the pump housing. It will be seen that the coil spring 53 will urge the top surface of the cap 36 against the bottom of the flange 58 and will also urge the washer 52 tightly against the end 60 of the counterbore 52 to provide a liquid tight seal. A further O-ring 59 in the cap cooperates with the rim of the container's neck 30 to provide further sealing.

Those skilled in the art will appreciate that this method of joining the cap 36 to the pump 58 will permit the cap to be rotated while the pump is held stationary. Thus, the cap 36 can be screwed on and off the jug with one hand while holding the pump stationary with the other.

The vaned rotor of the pump 38 (not shown) has an output shaft 60 to which a crank arm 62 is affixed by a locking bolt 64. Affixed to the crank arm 62 is a crank handle 66.

A venting port 68 is formed in the hollow handle 32 and is in fluid communication with the interior of the container 12. It is through this vent port 68 that air may enter and leave the jug or container 12 as a liquid is poured or pumped into the container and pumped out of the container. A plug 70 is provided for sealing the vent hole during long-term storage of the liquid within the container to block the escape of fumes or the like.

A tether strap 72 is wrapped about the outer diameter of the suction/discharge hose 46. The loop 74 in the tether may slide along the suction/discharge tube 46 to a desired location. Affixed to the free end of the strap or tether 72 is a spring-biased clamp 76.

OPERATION

In use, the container or jug 12 may be filled with a liquid to be dispensed. For the purposes of illustration only, the fluid transfer device 10 will be explained in the context of using it to fuel the gas tank of an internal combustion engine, such as on a racing vehicle. Once the container is filled at a bulk supply point, such as a gasoline station, by removing the cap 36 and its attached pump assembly 38 and inserting the nozzle of a fuel supply pump into the container, the cap 36 may be replaced such that the hose 41 will reach a location proximate the bottom 14 of the container. The filled container can be hand carried or transported on a suitable cart and ultimately moved to a point of use. The free end of the suction discharge hose 46 is then inserted into the fuel tank of the engine to be refueled and the clamp 76 is attached to a suitable anchor point as the hose 46 is pulled through the loop 74 and made to enter the tank to be filled. When properly adjusted, the open end of the hose is prevented from inadvertently being pulled out of the tank to be filled during the transfer operation. Any static electricity that may have built up on the assembly 10 becomes grounded via the tether and clamp to prevent any possible spark discharge.

Now, a person may transfer the fuel from the container 12 into the engine's fuel tank by rotating the crank 66 of the vane pump 38 in a first direction. A suction is created in the tube 41, thus drawing fuel through that tube and into the bell housing of the pump 38 where it is ultimately forced out of the hose 46. At this time, the vent port 68 of the container should be opened to permit entry of air into the jug 12 to replace the volume of liquid being extracted therefrom.

In certain applications it may be desirable to fill the container 12 from a vessel containing a liquid. Here again, the free end of the suction discharge hose 46 will be placed in the vessel to be emptied and the clamp 76 affixed to the vessel to prevent the tube 46 from accidentally being pulled out of the supply vessel. If the vessel to be emptied does not have a convenient point on which to clamp the tether, the clamp 76 can be used to hold a weight that can be placed in the vessel to prevent the hose 46 from falling out of the vessel. The crank 66 will then be rotated in an opposite direction from that which is used when discharging liquid from the container 12. This will create a suction force in the tube 46 and will draw the liquid from the supply vessel, through the pump 38 and into the jug 12, via the suction/discharge port 40 and the hose 41.

It can be seen, then, that there is provided a small, lightweight, portable pump and an associated container capable of transferring liquids in either direction, from or into the container. By adapting the pump to the container's cap or lid that is used to seal the container allows the pump to be utilized with any jug or container to which the cap may be affixed. This obviates the need to have a rotary vane pump for each container or jug. While in the preferred embodiment, the cap and neck are threaded to allow the cap to be screwed onto the neck of the jug, other ways of securing the cap to the jug can be devised.

The bi-directional pump allows the user to draw a liquid from a bulk container into the portable container or jug and then easily transport the portable unit to another location for redistribution of the contents.

Those skilled in the art will appreciate that the internal draw tube 41 and the external suction discharge hose 46 can have their length tailored to suit a variety of applications.

Because the suction discharge hose 46 will be anchored by the tether strap 72 in place within a container to be emptied or filled, there is no opportunity for spillage to occur as the liquid transfer operation takes place through rotation of the crank handle. Not only are spills avoided but fumes from volatile liquids are inhibited from escaping.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself

What is claimed is:

1. Fluid transfer apparatus comprising, in combination:

(a) a container for holding a predetermined volume of a liquid, the container including a bottom, an integrally formed sidewall and a top integrally formed with the sidewall, the top including an opening with a tubular neck surrounding the opening:

(b) a cap member adapted to be secured to the tubular neck and having an opening extending therethrough;

(c) a manually operated vane pump having first and second inlet/outlet ports, the first inlet/outlet port attached to a first tube extending through the opening in the cap member to a location proximate the container's bottom, the second inlet/outlet port being connected to a second tube of a predetermined length and (d) a spring-loaded seal ring contained within the cap and surrounding the first tube for preventing fluid leakage through the opening in the cap.

2. The fluid transfer apparatus as in claim 1 wherein the neck has external threads and the cap has internal threads whereby the cap can be screwed onto and from the neck of the container.

3. The fluid transfer apparatus as in claim 2 wherein provision of the spring-loaded seal ring permits the cap to be screwed onto and off from the container neck without rotating either the vane pump or the jug.

4. The fluid transfer apparatus as in claim 1 and further including a tether adjustably affixed along the length of the second tube, the tether including a clamp member for attachment to a stationary object to constrain inhibit static electric charge buildup and to displacement of an end portion of the second tube from a target location.

5. The fluid transfer apparatus as in claim 1 wherein the manually operated vane pump draws a liquid through the first inlet/outlet port and out the second inlet/outlet port when driven in a first direction and draws a liquid through the second inlet/outlet port and out the first inlet/outlet port when driven in an opposite direction.

6. Fluid transfer apparatus, comprising:

(a) a plastic jug of generally rectangular cross-section having a neck sealable by a cap and a carrying handle;

(b) a crank-operated rotary vane pump swivel mounted on the cap and having a first inlet/outlet port extending through the cap to an interior of the jug and a second inlet/outlet tube exterior of the jug so that the cap can be screwed onto and from the neck independent of rotation of the pump or the jug;

(c) a suction/discharge hose having a first end connected to the second inlet/outlet port and a second end for placement in a container for a liquid; and (d) a tether having one end slidable along an exterior of the suction/discharge hose and a clamp member affixed to another end of the tether adapted for releasable attachment to the container whereby the second end of the suction discharge hose is restrained from falling out of said container.

7. The fluid transfer apparatus as in claim 6 wherein rotation of the crank of the vane pump in a first direction draws a liquid from the jug and injects it into the container and rotation of the crank of the vane pump in an opposite direction draws the liquid from the container and injects it into the jug.

8. The fluid transfer apparatus as in claim 6 wherein the jug is of a capacity of between four and eight U.S. gallons.

9. The fluid transfer apparatus as in claim 6 wherein the first inlet/outlet port comprises a length of rigid pipe extending through a bore formed through a top surface of the cap; and a retainer ring surrounding the rigid pipe proximate an underside of the cap.

10. The fluid transfer apparatus as in claim 9 and further including a coil spring mounted on the rigid pipe for engaging the retainer ring and urging the cap into sealing engagement against a portion of the pump body surrounding the first inlet port.

11. The fluid transfer apparatus as in claim 6 wherein the tether precludes static electric charge buildup between the suction/discharge hose and the container to which the clamp is secured.

* * * * *

UNITED STATES PATENT AND TRADEMARK OFFICE

CERTIFICATE OF CORRECTION

PATENT NO. : 7,163,034 B2
APPLICATION NO. : 10/968396
DATED : January 16, 2007
INVENTOR(S) : Norman A. Franks It is certified that error appears in the above-identified patent and that said Letters Patent is hereby corrected as shown below:

Title Page: should read
(76) Inventor:
Norman Alton Franks

Signed and Sealed this

Tenth Day of April, 2007

JON W. DUDAS
*Director of the United States Patent and Trademark Office*